US006478442B2

(12) United States Patent
Chen

(10) Patent No.: US 6,478,442 B2
(45) Date of Patent: Nov. 12, 2002

(54) SCREWDRIVER HAVING A LIGHT EMITTING DEVICE

(76) Inventor: Sheng Ho Chen, 16F, No. 797, Chung Cheng Rd., Chungho City, Taipei Hsien (TW)

( * ) Notice: Subject to any disclaimer, the term of this patent is extended or adjusted under 35 U.S.C. 154(b) by 0 days.

(21) Appl. No.: 09/824,818

(22) Filed: Apr. 4, 2001

(65) Prior Publication Data

US 2002/0145866 A1 Oct. 10, 2002

(51) Int. Cl.[7] ..... F21L 14/02; F21V 33/00
(52) U.S. Cl. ..... 362/119; 362/206
(58) Field of Search ..... 362/206, 120, 362/119

(56) References Cited

U.S. PATENT DOCUMENTS 2,336,136 A * 12/1943 Thomson et al. ..... 362/120
4,733,337 A * 3/1988 Bieberstein ..... 362/206
5,628,556 A * 5/1997 Hrabar et al. ..... 362/120
5,826,969 A * 10/1998 Nevin ..... 362/120
5,980,077 A * 11/1999 Shiao ..... 362/120
6,030,092 A * 2/2000 McCalla et al. ..... 362/120
6,135,608 A * 10/2000 Lin ..... 362/119
6,145,995 A * 11/2000 Hung ..... 362/119

* cited by examiner

*Primary Examiner*—Laura K. Tso
(74) *Attorney, Agent, or Firm*—Rosenberg, Klein & Lee

(57) ABSTRACT

A screwdriver having a light emitting device according to the present invention comprises a handle, a shank, a light emitting device, and a light guiding sleeve. At least the front end portion of the handle is transparent. The handle has a receiving room therein. One end of the shank is connected to the front end of the handle, and the other end thereof forms a tip. The light emitting device is received in the receiving room of the handle. The light guiding sleeve is transparent and is sleeved on the shank. Thereby, light emitted by the light emitting device can be guided to the front end and be projected out to clearly illuminate the screw to be turned.

8 Claims, 5 Drawing Sheets

SCREWDRIVER HAVING A LIGHT EMITTING DEVICE

FIELD OF THE INVENTION

The present invention relates to a screwdriver having a light emitting device and, more particularly, to a screwdriver capable of guiding light emitted by a light emitting device therein to the front end thereof, so that light can be focused in front of the tip of the screwdriver to clearly illuminate the screw to be turned.

BACKGROUND OF THE INVENTION

A screwdriver is a kind of tool for turning screws. As shown in FIG. 1, a conventional screwdriver comprises a handle 10*a* and a shank 11*a*. One end of the shank 11*a* is fixedly connected with the handle 10*a,* and the other end thereof forms a cabinet tip or a Philips head tip 12*a*. One can grip the handle 10*a* with hands to let the tip 12*a* at one end of the shank 11*a* match the slotted head or the Philips head of a screw so that he can use the handle 10*a* to turn the shank 11*a* and the tip 12*a* for screwing or unscrewing the screw.

However, when the conventional screwdriver is used to turn a screw situated at a dim site, it is difficult to quickly match the tip 12*a* with the slotted head or the Philips head of the screw. One must try many times before he can match the tip 12*a* with the slotted head or the Philips head of the screw, resulting in much inconvenience.

Therefore, many kinds of screwdrivers having light emitting effect have been proposed. For screwdrivers having light emitting effect in the prior art, the light emitting devices (light bulbs) are generally disposed in the handles thereof. When light emitted by the light emitting device shines the vicinity of the tip at the front end of the shank, light will become rather weak because of factors such as scattering. Therefore, the screw to be turned cannot be clearly illuminated. The present invention aims to resolve the above problems in the prior art.

SUMMARY OF THE INVENTION

The primary object of the present invention is to provide a screwdriver having a light emitting device, whereby when a light source of the light emitting device is turned on, light emitted by the light source can pass through the front end of a handle and be guided by a light guiding sleeve to the front end to be projected out so that light can be focused in front of a tip of the screwdriver to clearly illuminate the screw to be turned. Thereby, when the screwdriver is used to turn a screw at a dim site, one can quickly and exactly match the tip of the screwdriver with the slotted head or the Philips head of the screw.

The various objects and advantages of the present invention will be more readily understood from the following detailed description when read in conjunction with the appended drawing, in which:

DETAILED DESCRIPTION OF THE PREFERRED EMBODIMENTS

Figure 1:
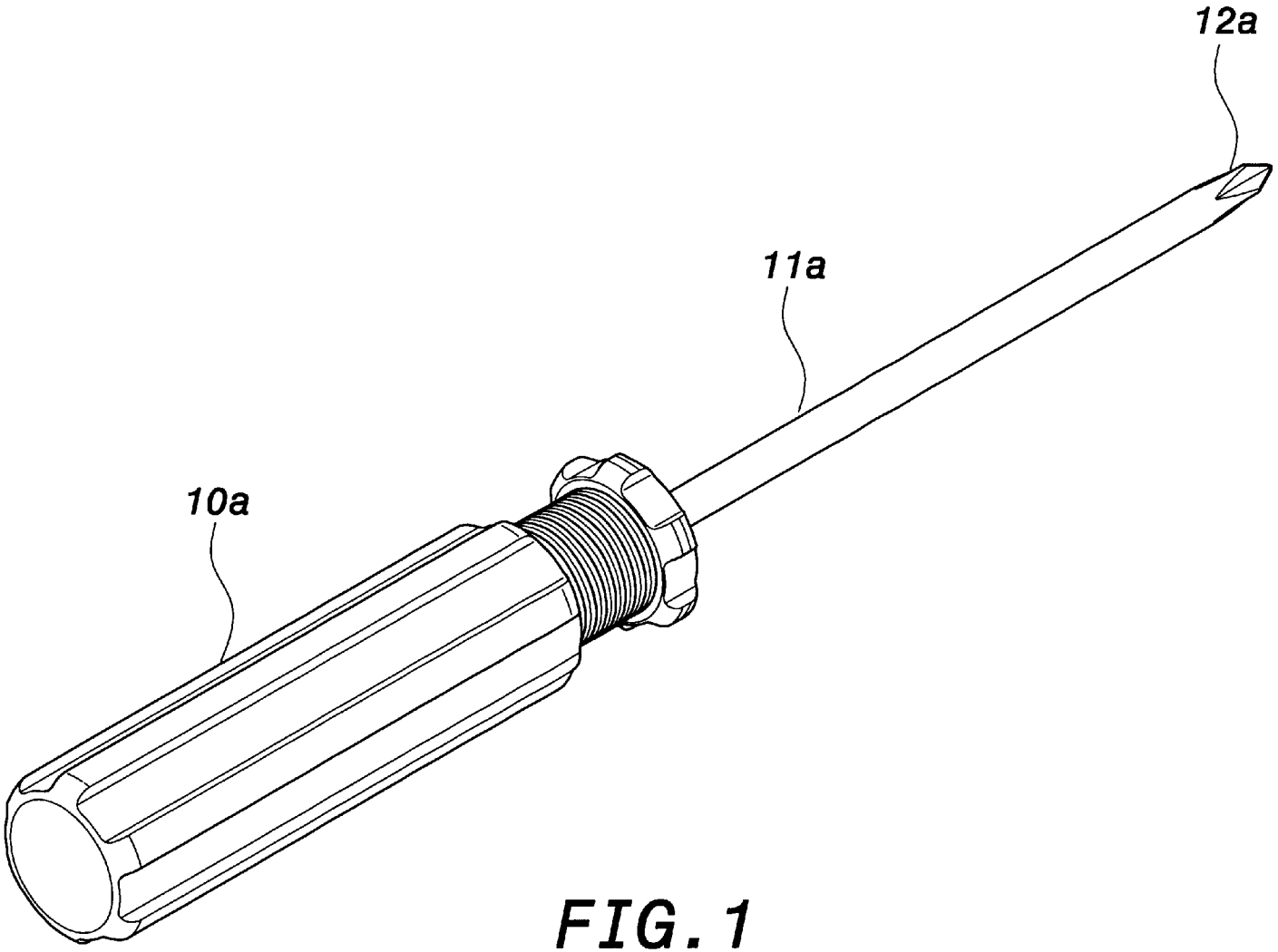
FIG. 1 PRIOR ART
FIG. 1 is a perspective view of a conventional screwdriver.
Figure 2:
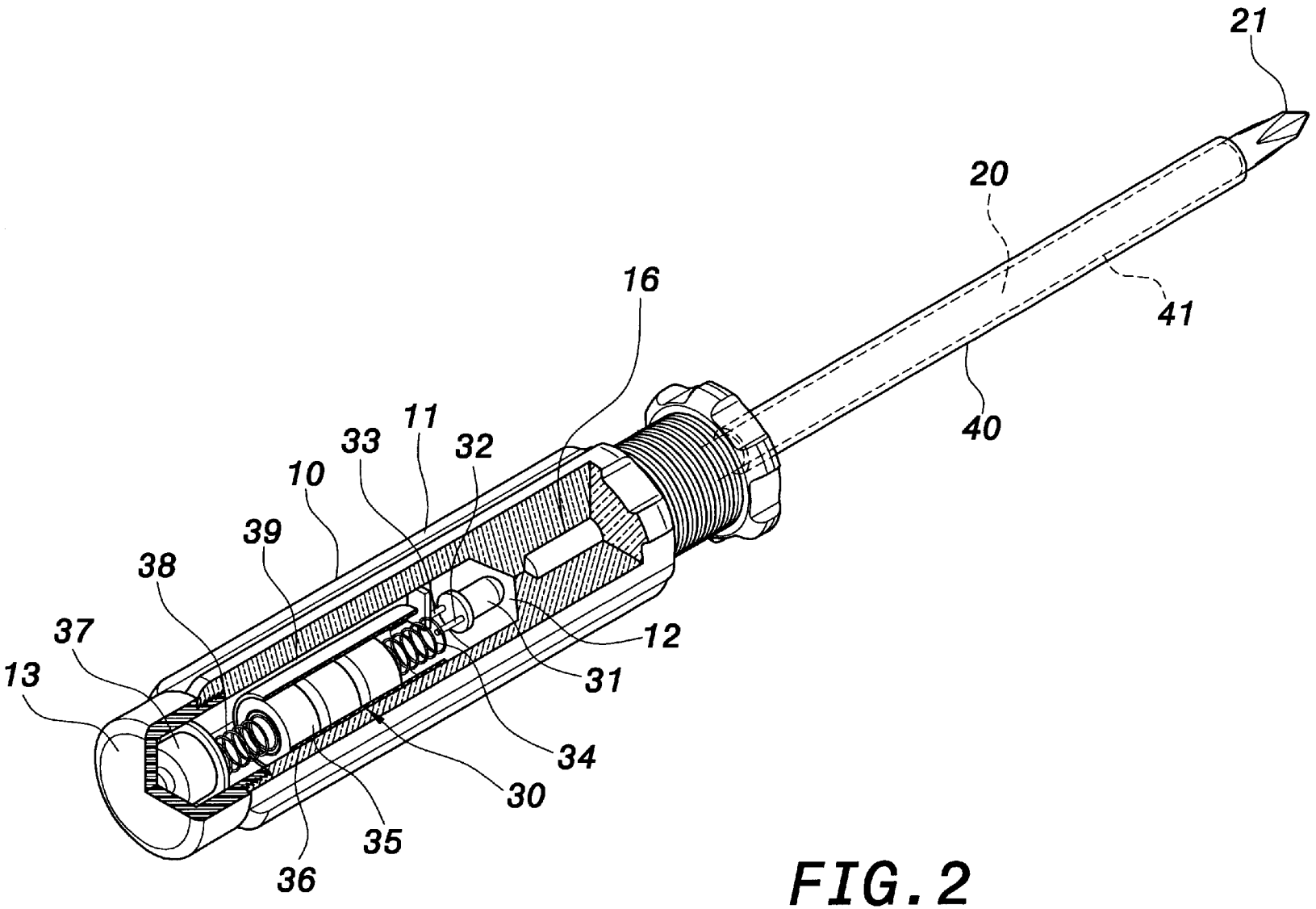
FIG. 2 is a perspective view of a screwdriver according to a first embodiment of the present invention.
Figure 3:
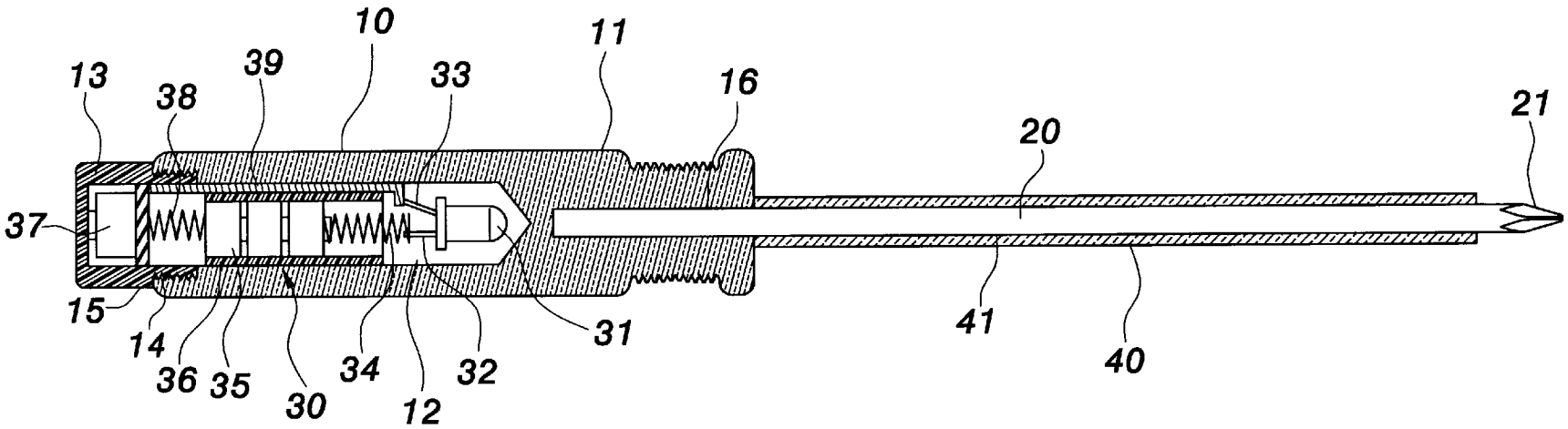
FIG. 3 is a cross-sectional view of a screwdriver according to the first embodiment of the present invention.

As shown in FIGS. 2 and 3, a screwdriver having a light emitting device according to the present invention comprises a handle 10, a shank 20, a light emitting device 30, and a light guiding sleeve 40. The handle 10 is a column of a proper length. The handle 10 is made of transparent plastic material, or at least, the front end portion thereof is made of transparent material so that light emitted by the light emitting device 30 can pass through the front end portion thereof. A plurality of longitudinally extending flutes 11 are formed on the surface of the handle 10 for increasing friction so that one can grip and turn the handle conveniently.

Figure 5:
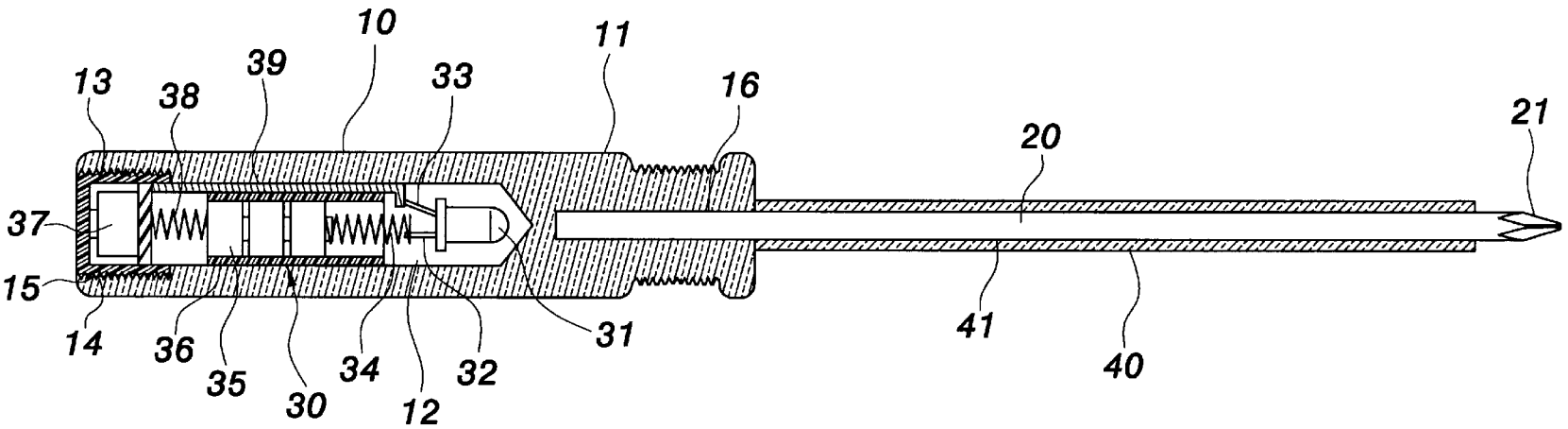
FIG. 5 is a cross-sectional view of a screwdriver according to a second embodiment of the present invention.

A receiving room 12 is disposed in the handle 10. The front end of the receiving room 12 forms a cone, and the rear end thereof is open for receiving the light emitting device 30. A first thread 14 can be formed on the inner wall (or the outer wall) of the receiving room 12. A cover body 13 is disposed at the rear end of the handle 10. The cover body 13 is made of resilient material such as rubber. A second thread 15 corresponding to the first thread 14 of the receiving room 12 is formed on the outer wall (or the inner wall) of the cover body 13. Through the mutual screwing of the first thread 14 and the second thread 15, the cover body 13 can be screwed and connected at the rear end of the handle 10 to close the rear opening of the receiving room 12. Moreover, the cover body 13 can protrudes out of the rear end of the handle 10, as shown in FIG. 3, or it can be hidden in the rear end of the handle 10, as shown in FIG. 5.

The shank 20 is made of metal material having better strength, and it can be a round shank, a square shank, or a shank of other shape. One end of the shank 20 is fixed in a connection hole 16 preset at the front end of the handle 10 so that the shank 20 can be fixedly connected at the front end of the handle 10. The other end thereof forms a Philips head tip, a cabinet tip, or a hexagon-bushing tip 21. In other words, the shape of the tip 21 can vary according to necessity.

The light emitting device 30 is received in the receiving room 12. The light emitting device 30 has a light source 31, which can be a light emitting diode (LED) or a light bulb. The light source 31 has a first lead 32 and a second lead 33. One end of the first lead 32 is connected to a first conductive spring 34.

A plurality of batteries 35 for supplying electricity for the light emitting device 30 can be disposed in the receiving room 12. One electrode of the batteries 35 contacts with the first conductive spring 34 so that electricity can be passed to the first lead 32 of the light source 31 via the first conductive spring 34. An insulating bushing 36 of hollow cylindrical shape is disposed in the receiving room 12. The bushing 36 is made of plastic material and is located outside the batteries 35. The bushing 36 can be used to prevent short circuit due to the contact of the batteries 35 with a conductive sheet 39.

The light emitting device 30 further has a switch 37, which is a push-button switch and is disposed at the rear end of the receiving room 12. The front end of the switch 37 is connected to a second conductive spring 38. The second lead 33 is connected to the conductive sheet 39. The rear end of the conductive sheet 39 is connected to the switch 37. The switch 37 is located in the cover body 13 and contacts with the inner wall of the rear end of the cover body 13. When the cover body 13 is pressed, the cover body will deform so that the inner wall of the rear end thereof can trigger the switch to turn it on or off.

When the switch 37 is turned on, electricity from the other electrode of the batteries 35 can be passed through the second conductive spring 38, the switch 37, and the conductive sheet 39 to the second lead 33 of the light source 31, thereby forming a closed loop. The light source 31 can thus be turned on. Contrarily, when the switch 37 is turned off, an open circuit is formed, and the light source 31 will be turned off.

The light guiding sleeve 40 is made of transparent plastic material and is a hollow tube of a proper length. The light guiding sleeve 40 has a through hole 41 therein corresponding to the shape of the shank 20. The shank 20 is sleeved in the through hole 41 of the light guiding sleeve 40. The rear end of the light guiding sleeve 40 abuts tightly against the front end of the handle 10, and the front end thereof extends to be near the tip 21 at the front end of the shank 20. Thereby, a screwdriver having a light emitting device according to the present invention is formed.

Figure 4:
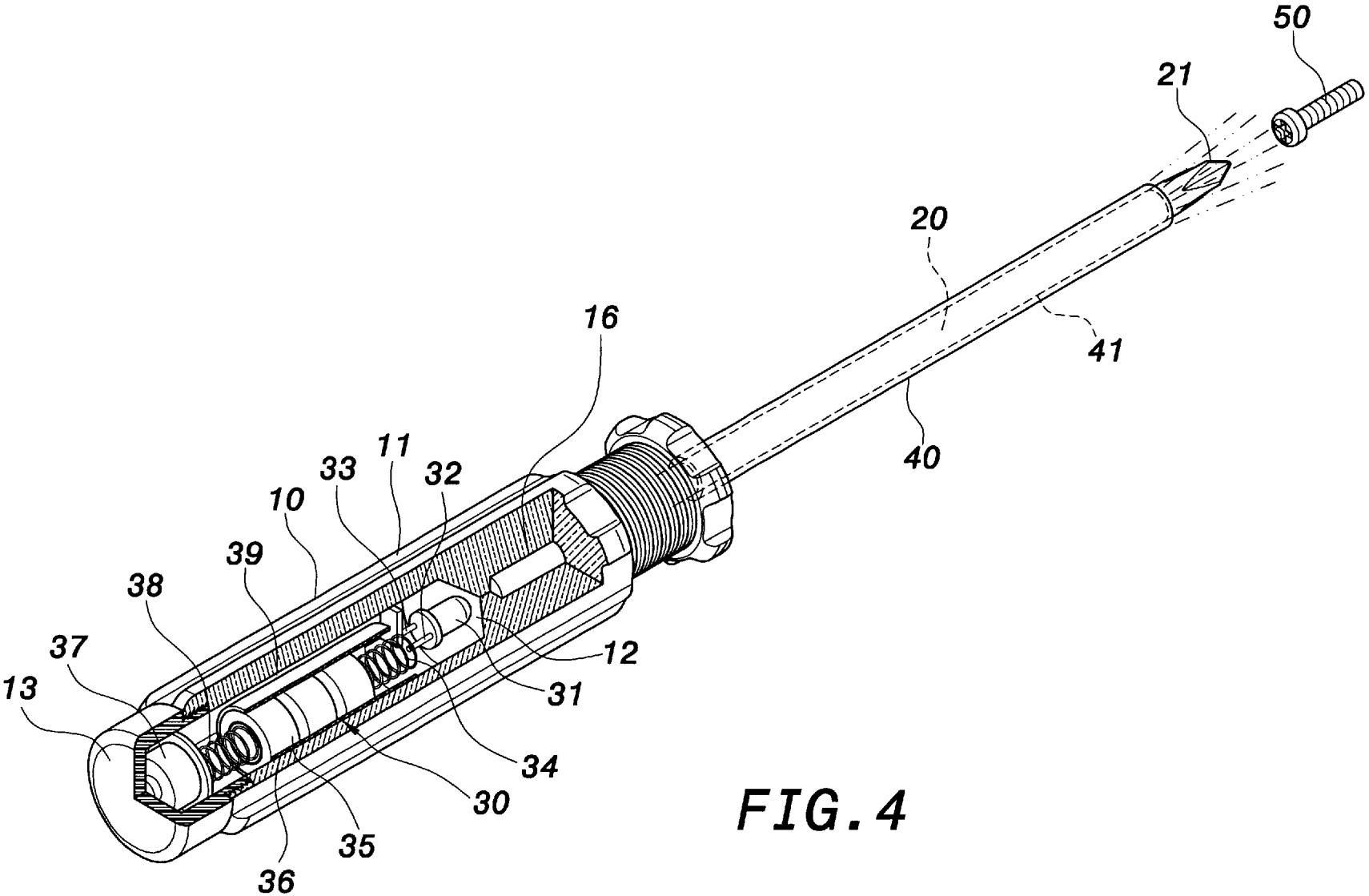
FIG. 4 is a view showing the use state of a screwdriver according to the first embodiment of the present invention.

As shown in FIG. 4, when one presses the cover body 13 to turn on the light source 31 of the light emitting device 30, light emitted by the light source 30 can pass through the front end of the handle 10 and be guided by the light guiding sleeve 40 to the front end to be projected out so that light can be focused in front of the tip 21 to clearly illuminate the screw to be turned. Thereby, when the screwdriver is used to turn a screw situated at a dim site, one can quickly and exactly match the tip 21 of the screwdriver with the slotted head or the Philips head of the screw.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A screwdriver having a light emitting device, comprising:

a handle having a transparent front end portion and a receiving room;

a shank having two opposing ends, said shank having one end connected to a front end section of said handle and the other end forming a tip, a light emitting device housed in said receiving room of said handle; and a light guiding sleeve positioned on said shank, said light guiding sleeve having a rear end portion and a front end portion, said rear end portion abutted tightly against said front end section of said handle, said front end portion substantially extended to said tip of said shank.

2. The screwdriver having a light emitting device as claimed in claim 1, wherein the surface of said handle has a plurality of longitudinally extending flutes.

3. The screwdriver having a light emitting device as claimed in claim 1, wherein said shank is a round shank or a square shank.

4. The screwdriver having a light emitting device as claimed in claim 1, wherein said tip of said shank can be a Philips head tip, a cabinet tip, or a hexagon-bushing tip.

5. The screwdriver having a light emitting device as claimed in claim 1, wherein said light emitting device has a light source, said light source having a first lead and a second lead, said first lead being connected to a first conductive spring, batteries being disposed in said receiving room, one electrode of said batteries contacting with said first conductive spring, an insulating bushing being disposed in said receiving room and situated outside said batteries, said light emitting device further having a switch connected to a second conductive spring, said second lead of said light source being connected to a conductive sheet connected to said switch.

6. The screwdriver having a light emitting device as claimed in claim 5, wherein the rear end of said handle joins a cover body made of resilient material, and said switch contacts with the inner wall of the rear end of said cover body so that said switch can be triggered by pressing said cover body.

7. The screwdriver having a light emitting device as claimed in claim 6, wherein said cover body is connected at the rear end of said handle by screwing, and said cover body can protrude out of the rear end of said handle or be hidden in the rear end of said handle.

8. The screwdriver having a light emitting device as claimed in claim 1, wherein said light guiding sleeve is made of transparent material.

* * * * *